US005808254A

United States Patent [19]

Wu

[11] Patent Number: 5,808,254

[45] Date of Patent: Sep. 15, 1998

[54] SWITCH FOR FOUR-QUARTERS CLOCK

[76] Inventor: Tey-Jen Wu, 6F., No.195, Sec.3, Le-Li Road, Taipei, Taiwan

[21] Appl. No.: 679,231

[22] Filed: Jul. 12, 1996

[51] Int. Cl.[6] ..... H01H 35/02

[52] U.S. Cl. ..... 200/61.45 R; 200/61.52; 200/DIG. 29

[58] Field of Search ..... 200/61.52, DIG. 2, 200/277, 61.45 R, 61.53, 61.83

[56] References Cited

U.S. PATENT DOCUMENTS 3,935,701 2/1976 Yamaguchi et al. ..... 200/61.52 X
3,955,356 5/1976 Lecocq ..... 200/61.52 X
4,503,299 3/1985 Henrard et al. ..... 200/61.52
4,751,353 6/1988 Stephens ..... 200/61.52 X
4,766,275 8/1988 Hemmann et al. ..... 200/61.52 X

*Primary Examiner*—J. R. Scott
*Attorney, Agent, or Firm*—Bacon & Thomas

[57] ABSTRACT

A clock capable of automatically switching to any one of plural functions when the clock is turned to stand on each of four sides is controlled by a gravity operated switch that includes a pair of orthogonally positioned frames, with each frame containing a pair of opposed holding areas, a pair of opposed stop areas, a pair of conductors disposed in each holding area and a steel ball movable between the stop and holding areas for either connecting the conductors in each holding area to electrically execute a function or be disposed in a stop area where no function is executed.

3 Claims, 4 Drawing Sheets

SWITCH FOR FOUR-QUARTERS CLOCK

BACKGROUND OF THE INVENTION

1. Field of the Invention

The present invention relates to a switch for a four-quarters clock capable of being used in four different orientations, and especially to a switch capable of automatic switching to obtain an expected special function when the clock is turned to stand on each of its four sides. Wherein, in each of two limiting frames orthogonal to each other, having 90 degrees of angle therebetween, a steel ball is provided. When the clock is in one of the four orientations, the steel ball and one of the limiting frames rolls by gravity to electrically connect a pair of downwardly extending conducting legs with each other, while the steel ball in the other of the limiting frames rolls by gravity to a stop area. Thus, four functions of the clock are capable of being realized in four orientations and can be switched automatically.

2. Description of the Prior Art

A four-quarters clock is a clock capable of being used in four different orientations by using any of the four sides of the clock as a base, with each side being assigned with a particular function. When the clock is placed on a desk or some other flat surface with any one side as a base, it can execute the function provided by that side. For example, the first side may show the local time, the second side may be given a time for alarm, the third side may show the time of a certain city of a certain country, while the fourth side may show the date. When the clock is placed on the first side, the display panel will display the local time, and when it is turned onto the second side, the display panel will display automatically the set time for the alarm, and so forth for the third and the fourth sides.

The basic structure of a prior art four-quarters clock is shown in FIG. 1 and is comprised of a front lid 1 having a square frame, a rear hood 2 having the same shape as that of the front lid 1, a switch 3, a control circuit board 4 and a display panel 5. When the front lid 1 and the rear hood 2 are assembled, the switch 3 and the control circuit board can be held therein. The display panel 5 can be positioned in the middle of the front lid to complete a clock. When a user places the clock on a desk with one side thereof as a base, the switch will automatically connect a set of functional connecting legs with each other to cause the control circuit board 4 to give a corresponding output signal which is displayed on the display panel 5.

In the conventional clock, the above-mentioned switch 3 has the structure as shown in FIG. 2 and is comprised of a hollow square housing lid 31, a cross-shaped frame 32 provided in the housing lid 31, a freely rolling steel ball 33 and four pairs of conducting legs 34 provided respectively at the four corners of the housing lid 31. One end of each of the conducting legs 34 extends into one of the four grooves 321 of the cross-shaped frame 32, while the other end thereof is connected to the circuit of the control circuit board 4. In this way, when the steel ball 33 freely rolls by gravity due to changing orientation of the clock, it can fall into a corresponding groove 321 of the cross-shaped frame 32 to automatically and electrically connect a pair of functional connecting legs 34 with each other, and thus the automatic switching of the four-quarters clock can be achieved.

However, the conventional switch has its disadvantage in that four convex angles 322 are formed between every two adjacent grooves 321 of the cross-shaped frame 32, so that when a groove 321 faces downwards, the upper walls of the two convex angles 322 are disposed in a horizontal plane. Thus, the speed of orientation changing of the clock is slow, and the steel ball 3 may possibly be unable to roll and fall into the lower groove 321.

SUMMARY OF THE INVENTION

In view of this, the inventor of the present invention improves the structure of the above-stated switch to remove the inability of the steel ball to quickly fall into the desired lower groove. Therefore, the primary object of the present invention is to provide a switch for a four-quarters clock which permits the steel ball to quickly fall into the desired lower groove to automatically and electrically connect a pair of functional conducting legs with each other when the clock changes its orientation.

In particular, the switch for a four-quarters clock of the present invention is comprised of two limiting frames positioned orthogonal to each other or having 90 degrees of angle therebetween. Inside each of the two limiting frames are two opposed holding areas and two opposed stop areas. An imaginary central line extending through the two holding areas and a similar line through the two stop areas in the same limiting frame are perpendicular to each other. Each individual area is disposed at one of the four quarters of the frame. When one holding area in a limiting frame faces downwards, the opposite upper side is the other holding area and the lateral sides are the two stop areas. The arrangement in the other limiting frame orthogonally disposed to the first limiting frame is just the opposite. Its two stop areas are located at the upper and the lower sides, while its holding areas are located at the lateral sides. A freely rolling steel ball and two pairs of conducting legs are provided in each of the two limiting frames, with the contact ends of the conducting legs being located in the holding areas. When steel balls are located in the holding areas, they electrically connect the respective contact ends with each other, and the connecting ends of the conducting legs are connected to a control circuit board of the clock.

The switch for a four-quarters clock of the present is shown in FIGS. 3 and 4. The present invention will be apparent in its practical structure, characteristics and functions from the following detailed description of the preferred embodiment thereof with reference to the accompanying drawings.

DETAILED DESCRIPTION OF THE PREFERRED EMBODIMENT

Figure 1:
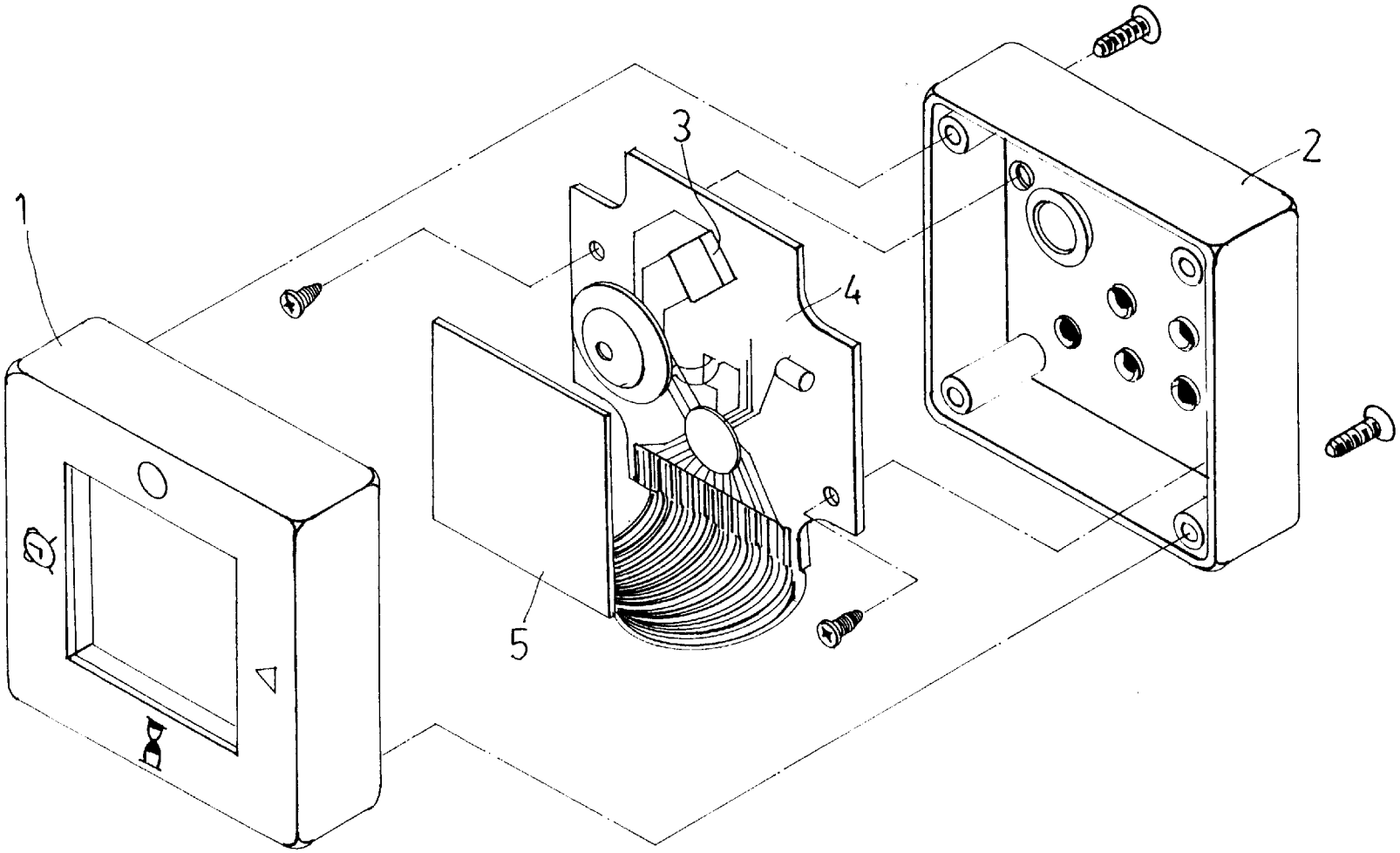
Fig. 1 PRIOR ART
FIG. 1 is an exploded perspective view of a switching structure for a clock of the prior art.
Figure 2:
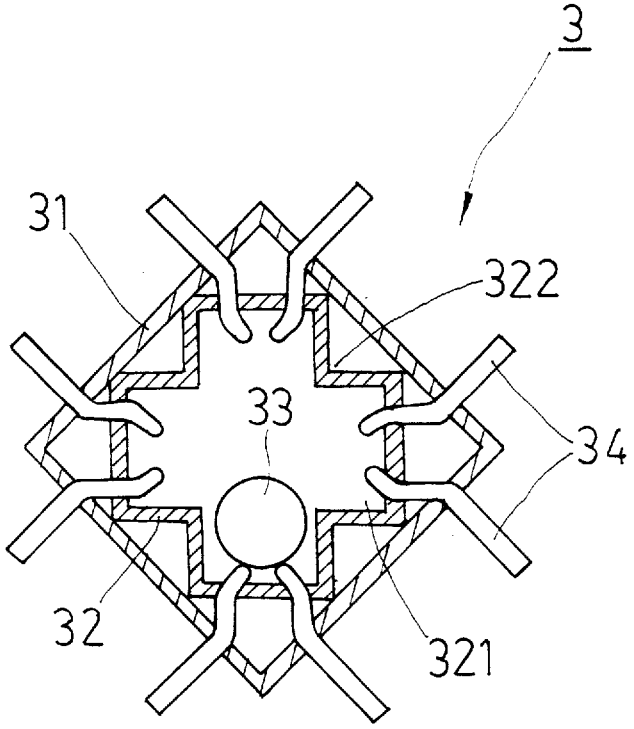
Fig. 2 PRIOR ART
FIG. 2 is a schematic view of the switching structure of the clock of the prior art.
Figure 3:
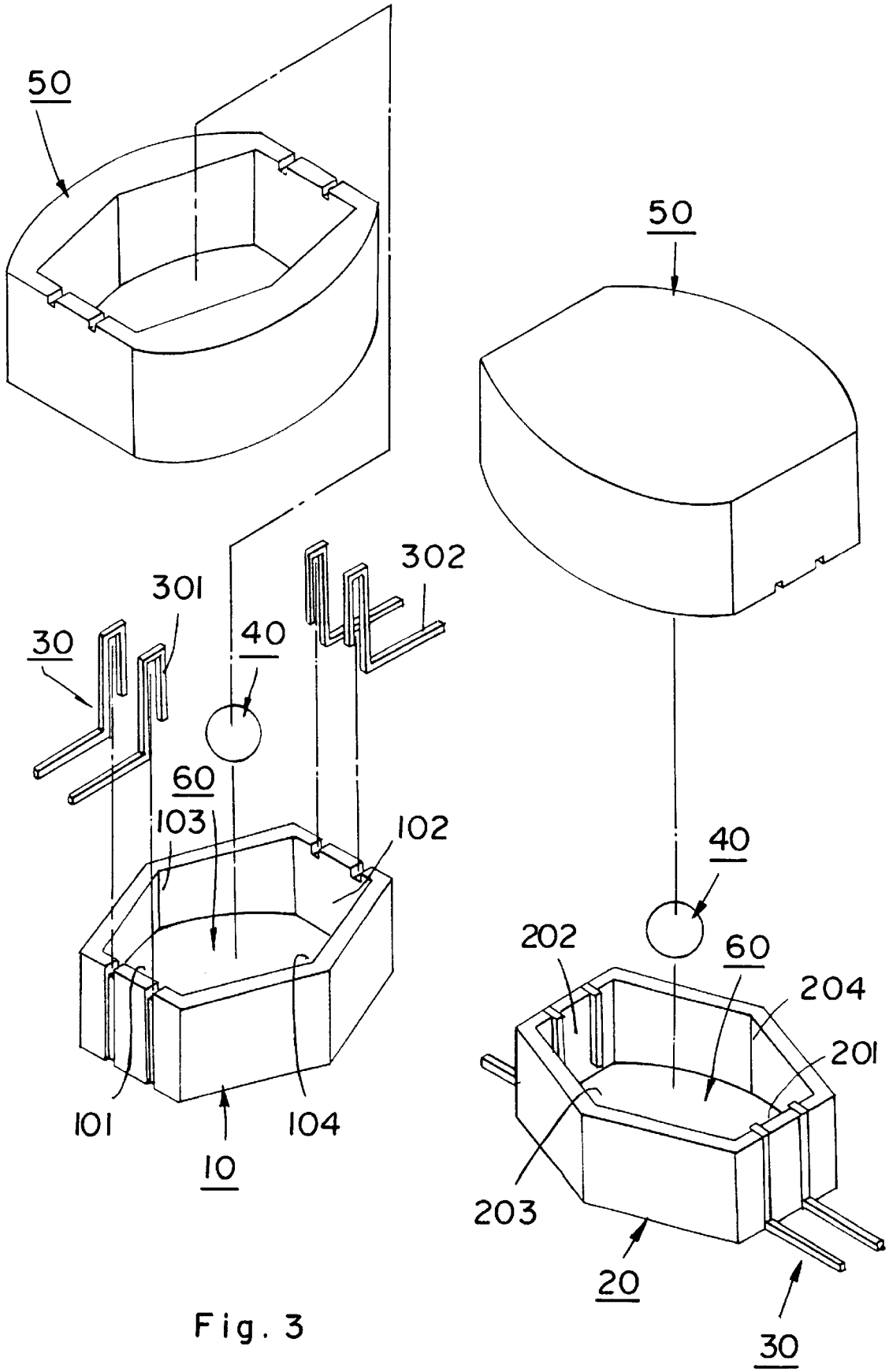
FIG. 3 is an exploded perspective view of the structure of the present invention.

Referring now to FIG. 3, the switching mechanism for a four-quarters clock of the present invention is comprised of two limiting frames 10, 20 orthogonal to each other or having 90 degrees of angle therebetween. Inside the two limiting frames 10, 20 are two holding areas (101, 102), (201, 202) and two stop areas (103, 104), (203, 204), respectively. An imaginary central line through the two holding areas (101, 102) and a similar line through the two stop areas (103, 104) in the same limiting frame 10 are orthogonal or perpendicular to each other. In other words, when one holding area 101 in the limiting frame 10 faces downwards, the opposite upper side is the other holding area 102, with the two stop areas (103, 104) being disposed at the lateral sides. The arrangement in the other limiting frame 20 orthogonally disposed to the limiting frame 10 is just the opposite. Its two stop areas (203, 204) are located at the upper and the lower sides, while its holding areas (201, 202) are located at the lateral sides.

A freely rolling steel ball 40 and two sets of pairs of conducting legs 30 are provided in each of the two limiting frames 10, 20. The conducting legs 30 all have contact ends 301 and connecting ends 302, with the contact ends 301 being located in the holding area (101, 102), (201, 202) and the connecting ends 302 extending outwardly from the holding areas (101, 102), (201, 202) for connection to a control circuit board of the clock. The steel balls 40 can roll in the two limiting frames 10, 20, and when they roll to any holding area (101, 102), (201, 202), they electrically connect the respective contact ends 301 of the conducting legs 30 with each other to render the contact ends 301 conductive.

Figure 4B:
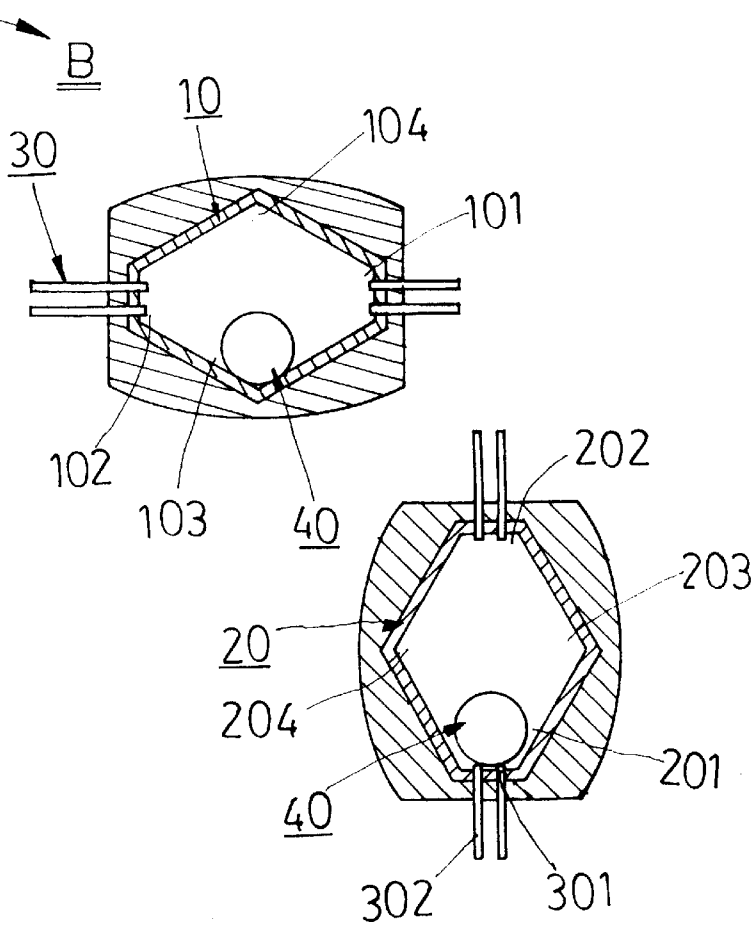
FIG. 4B is a schematic view of the present invention showing the switching mechanism in its next second position.
Figure 4A:
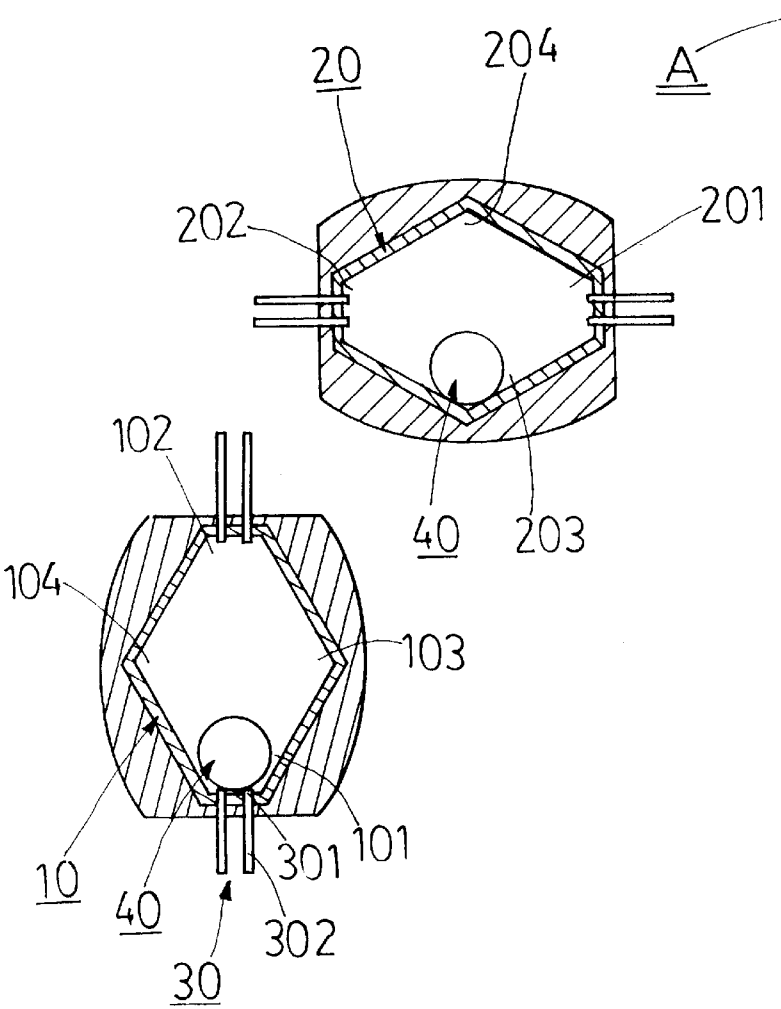
FIG. 4A is a schematic view of the present invention showing the switching mechanism in a first position.

Referring to FIG. 4A and FIG. 4B, by means of the above stated structure, when the clock is in one the four possible orientations, the holding areas (101, 102) of the limiting frame 10 are at the upper and the lower sides, while the stop areas (103, 104) are at the lateral sides. Hence, the steel ball 40 and the limiting frame 10 rolls by gravity to fall into the holding area 101 facing downwardly to connect the contact ends 301 of the conducting legs 30 with each other to render the contact ends 301 electrically conductive, and to cause the control circuit board to execute the function corresponding to this orientation through the connecting ends 302. At the same moment, the steel ball 40 in the other limiting frame 20 orthogonally placed to the limiting frame 10 has its stop area 203 located at the lower side and its holding areas (201, 202) located at its lateral sides. The ball 40 is positioned by gravity at the stop area 203 and executes no function to the clock.

When the clock is turned for 90 degrees from the foregoing orientation shown in FIG. 4A to another orientation shown in FIG. 4B, the holding areas (101, 102) of the limiting frame 10 are changed to its lateral sides, while the stop areas (103, 104) are changed to its upper and lower sides. Hence, the steel ball 40 in the limiting frame 10 rolls under gravity into the stop area 103 and thus executes no function to the clock. At the same moment, the two stop areas (203, 204) in the other limiting frame 20 are changed to its lateral sides, while its holding areas (201, 202) are changed to its upper and lower sides, respectively. The steel ball 40 in the limiting frame 20 automatically rolls under gravity into the holding area 201 to connect the contact ends 301 of the conducting legs 30 in the holding area 201 with each other to render the contact ends 301 electrically conductive, and to cause the control circuit board to execute the function corresponding to this orientation through the connecting ends 302 of the conducting legs 30. In this way, switching of the clock can be automatically and easily achieved.

Referring again to FIG. 3, in order to prevent the conducting legs 30 and the steel balls 40 from dropping out, a lid can be provided in front of each of the limiting frames (10, 20), thereby preventing the steel balls 40 from rolling out the front of the limiting frames (10, 20). The rear sides of the limiting frames (10, 20) are each provided with a back plate 60, so that the steel balls 40 will be confined in the limiting frames (10, 20). The lids 50 and the back plate 60 are provided at the front and rear sides of the clock, respectively.

If a user places the clock on a desk with either the front or rear side thereof as a base, the steel balls 40 will not possibly make contact with any set of conducting legs 30. Therefore, the lids 50 and the stop plates 60 at the front and rear of the clock may each be provided with a convex middle portion extending into the clock, with the arcuate shape of the portions being declined towards the holding areas (101, 102), (201, 202), respectively. Thus, when the clock is placed on a desk with the front or rear side thereof as a base, the steel balls 40 located on the lids or the stop plates 60 automatically roll under gravity toward the holding areas (101, 102), (201, 202) of the limiting frames (10, 20) to contact two sets of conducting legs 30. The clock will therefore execute the function activated by the first set of conducting legs 30 connected by the first one of the two steel balls 40. In other words, by the switch composed of the above stated elements in the clock, regardless of the clock orientation, there is at least one set of conducting legs conductively connected, and when the clock is changed to another orientation, it can be switched to another function, thus overcoming the disadvantage of the prior art clock.

Having now particularly described in detail the nature of the invention and in what manner the same is to be practiced, what is claimed is:

1. A switch for automatically activating each of plural different functions of a clock having plural sides through a control circuit board when a selected side of the clock is disposed on a support surface, with each side of the clock defining a different orientation corresponding to a different function, the switch comprising:

a) a pair of orthogonally positioned limiting frames, an imaginary central axis of each frame being perpendicular to an imaginary central axis of the other frame, each frame including a pair of opposed holding areas and a pair of opposed stopping areas, whereby whenever the holding areas of one frame are disposed vertically, the holding areas of the other frame are disposed horizontally;

b) each holding area including a pair of conductive legs having a pair of spaced contact ends disposed within the frame and a pair of connection ends for electrical connection to the central circuit board;

c) a steel ball disposed within each frame and rollable under gravity for selective disposition within the holding and stopping areas of the frames in response to change in the orientation of the clock such that whenever the ball of one frame is disposed in a holding area, the ball of the other frame is disposed in a stopping area; and d) whereby when a ball is in a holding area of a frame, the ball engages the spaced contact ends of the conductive legs in that area and renders the legs electrically conductive to activate the function corresponding to the orientation of the clock through the control circuit board.

2. The switch of claim 1 wherein each limiting frame includes a front and a rear, a lid being provided at the front and a stop plate being provided at the rear.

3. The switch of claim 2 wherein each lid and each stop plate includes a convex middle portion extending into the frame for directing the ball towards a holding area.

* * * * *